US011646128B2

(12) United States Patent
Ooi

(10) Patent No.: US 11,646,128 B2
(45) Date of Patent: May 9, 2023

(54) COVERED WIRE AND WIRE HARNESS

(71) Applicant: SUMITOMO WIRING SYSTEMS, LTD., Mie (JP)

(72) Inventor: Hayato Ooi, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 17/510,639

(22) Filed: Oct. 26, 2021

(65) Prior Publication Data

US 2022/0139592 A1 May 5, 2022

(30) Foreign Application Priority Data

Oct. 30, 2020 (JP) ..... JP2020-182212

(51) Int. Cl.

| | |
|---|---|
| ***H01B 3/44*** | (2006.01) |
| ***H01B 7/282*** | (2006.01) |
| ***H01B 7/00*** | (2006.01) |
| ***H01B 7/295*** | (2006.01) |

(52) U.S. Cl.

CPC ..... *H01B 3/44* (2013.01); *H01B 7/0045* (2013.01); *H01B 7/282* (2013.01); *H01B 7/295* (2013.01)

(58) Field of Classification Search

CPC ..... H01B 3/44; H01B 7/0045; H01B 7/282

See application file for complete search history.

(56) References Cited

U.S. PATENT DOCUMENTS

| | | | | |
|---|---|---|---|---|
| 4,791,240 | A * | 12/1988 | Marin | H01B 7/288 252/570 |
| 2006/0121738 | A1* | 6/2006 | Egitto | H05K 3/384 438/694 |
| 2007/0134506 | A1* | 6/2007 | Chasey | C08L 23/142 427/117 |
| 2016/0019999 | A1* | 1/2016 | Yamasaki | H02G 1/14 174/72 A |
| 2020/0399459 | A1 | 12/2020 | Shimada | |

* cited by examiner

*Primary Examiner* — Krystal Robinson

(74) *Attorney, Agent, or Firm* — Venjuris, P.C.

(57) ABSTRACT

Provided are a covered wire and a wire harness having excellent heat resistance and an excellent appearance. Provided is a covered wire including a conductor and an insulating covering, in which the insulating covering is made of a resin composition, the resin composition includes a silane graft polyolefin, an unmodified polyolefin, a modified polyolefin having one or more functional groups selected from the group consisting of a carboxy group, an ester group, an acid anhydride group, an amino group, and an epoxy group, a flame retardant, a cross-linking catalyst, and zinc oxide and an imidazole-based compound, and the surface roughness Ra of the insulating covering is 4.0 μm or less.

9 Claims, 2 Drawing Sheets

COVERED WIRE AND WIRE HARNESS

CROSS-REFERENCE TO RELATED APPLICATIONS

This application is based on and claims priority from Japanese Patent Application No. 2020-182212, filed on Oct. 30, 2020, with the Japan Patent Office, the disclosure of which is incorporated herein in their entireties by reference.

TECHNICAL FIELD

The present disclosure relates to a covered wire and a wire harness.

BACKGROUND

Japanese Patent Laid-open Publication No. 2019-163406 discloses an insulated wire with an insulating covering obtained by cross-linking a specific polyolefin-based composition, as an insulated wire with excellent heat resistance.

SUMMARY

A covered wire having excellent heat resistance and an excellent appearance is desired.

Japanese Patent Laid-open Publication No. 2019-163406 discloses zinc oxide and an imidazole-based compound as additives for improving heat resistance in the above-described composition. The present inventor has found that zinc oxide and imidazole-based compounds can affect the appearance of the insulating covering. Specifically, the surface of the insulating covering becomes rough.

Also, in applications where a water blocking property is required in the covered wire, a tubular water blocking member is attached to the outer periphery of the covered wire. If the surface of the insulating covering is rough, the water blocking member does not come into areal contact with the outer peripheral surface of the insulating covering. For this reason, a small gap may appear between the insulating covering and the water blocking member. Due to the above-described small gap, the water blocking property between the insulating covering and the water blocking member is reduced.

In view of the above description, one of the objects of the present disclosure is to provide a covered wire having excellent heat resistance and an excellent appearance. Another object of the present disclosure is to provide a wire harness including a covered wire having excellent heat resistance and an excellent appearance.

The covered wire of the present disclosure is a covered wire including a conductor and an insulating covering, in which the insulating covering is made of a resin composition, the resin composition includes a silane graft polyolefin, an unmodified polyolefin, a modified polyolefin having one or more functional groups selected from the group consisting of a carboxy group, an ester group, an acid anhydride group, an amino group, and an epoxy group, a flame retardant, a cross-linking catalyst, and zinc oxide and an imidazole-based compound, and a surface roughness Ra of the insulating covering is 4.0 μm or less.

The wire harness of the present disclosure includes the covered wire of the present disclosure, a terminal, and a water blocking member, the terminal is attached to at least one of two end portions of the covered wire, and the water blocking member is attached to an outer periphery of the insulating covering.

The covered wire of the present disclosure and the covered wire included in the wire harness of the present disclosure have excellent heat resistance and an excellent appearance.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
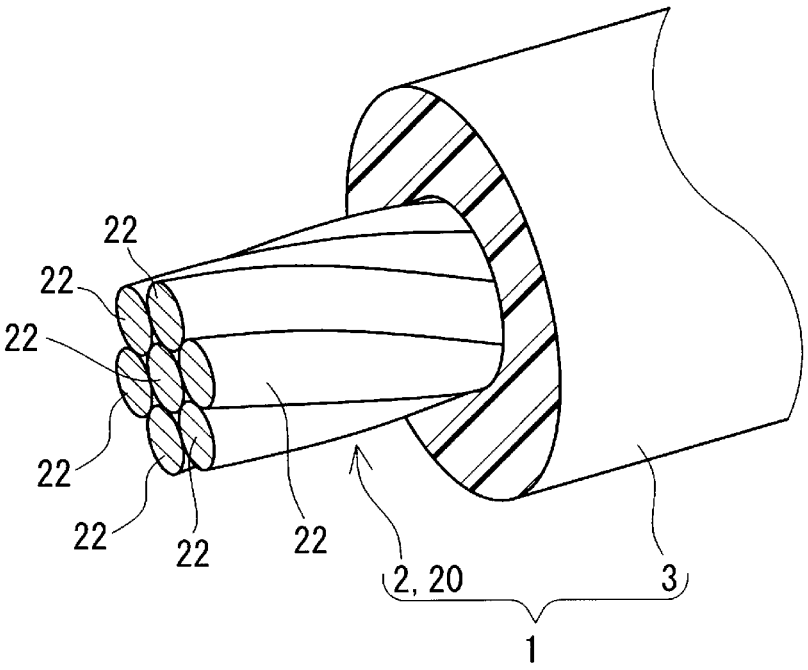
FIG. 1 is a perspective view showing an example of a covered wire of an embodiment.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

DESCRIPTION OF THE EMBODIMENTS OF THE DISCLOSURE

The covered wire of the present disclosure is based on the following findings.

When a resin mixture to be used as raw material for an insulating covering is a polyolefin-based composition containing the above-described zinc oxide and imidazole-based compound, the surface of the insulating covering becomes rough in some cases. One of the reasons for this is thought to be that zinc oxide and imidazole-based compounds reduce the fluidity of the resin mixture when the resin mixture is extruded to form the insulating covering. As a result of examining the improvement of the fluidity of the resin mixture, the present inventor found that the amount of moisture in the above-described resin mixture is related to the surface roughness of the insulating covering. When the amount of moisture is large, the distribution states of air bubbles that appear due to vaporization of the moisture on the inside of the resin mixture and on the outer surface of the resin mixture may be different from each other. It is thought that the fluidity of the resin mixture may decrease due to the above-described difference in the distribution states of the air bubbles. Due to the fluidity of the resin mixture decreasing, a defect phenomenon such as a melt fracture is likely to occur during extrusion. It is thought that an insulating covering having a rough surface is molded due to melt fracture or the like. The inventor of the present invention found that when the amount of moisture in the resin mixture is appropriately adjusted, and in particular, when the amount of moisture is small to some extent, an insulating covering having a smooth surface is manufactured.

First, the contents of the embodiments of the present disclosure will be listed and described.

(1) The covered wire according to one aspect of the present disclosure is a covered wire including a conductor and an insulating covering, in which the insulating covering is made of a resin composition, the resin composition includes a silane graft polyolefin, an unmodified polyolefin, a modified polyolefin having one or more functional groups selected from the group consisting of a carboxy group, an ester group, an acid anhydride group, an amino group, and an epoxy group, a flame retardant, a cross-linking catalyst, and zinc oxide and an imidazole-based compound, and a surface roughness Ra of the insulating covering is 4.0 μm or less.

The covered wire of the present disclosure has excellent heat resistance due to containing zinc oxide and an imidazole-based compound. Since the insulating covering containing the cross-linking catalyst is generally cross-linked, the covered wire of the present disclosure has excellent heat resistance.

Since the surface roughness Ra of the insulating covering is small as described above, the surface of the insulating covering is smooth. Such a covered wire of the present disclosure also has an excellent appearance. When a water blocking member is attached to the outer periphery of the covered wire of the present disclosure, the insulating covering and the water blocking member are in areal contact with each other. For this reason, the covered wire of the present disclosure also has an excellent water blocking property. Note that the surface roughness Ra is the arithmetic mean roughness. Also, since the surface of the insulating covering is smooth, it is easy to attach the water blocking member. From this point of view, when the covered wire of the present disclosure is used for a wire harness for waterproofing, the wire harness has excellent manufacturability.

Furthermore, since the surface of the insulating covering is smooth, cutting debris from the insulating covering is less likely to be generated when the covered wire of the present disclosure is cut. For this reason, in the task of attaching the terminal to the end portion of the covered wire, which is cut as described later, a decrease in workability due to the cutting debris can be suppressed. From this point of view, when the covered wire of the present disclosure is used for a wire harness, the wire harness has excellent manufacturability.

(2) Examples of the covered wire of the present disclosure include a mode in which the unmodified polyolefin includes block polypropylene.

In the above-described mode, the resin mixture that is the raw material of the insulating covering in the manufacturing process has excellent fluidity. For this reason, it is easy to manufacture a covered wire having an excellent appearance. In this respect, the above-described mode has excellent manufacturability.

(3) Examples of the covered wire of the present disclosure include a mode in which the surface roughness Ra is 3.0 μm or less.

The above-described mode has a more excellent appearance, water blocking property, and workability during attachment of the terminal.

(4) Examples of the covered wire of the present disclosure include a mode in which the surface roughness Ra is 2.0 μm or less.

The above-described mode has an even more excellent appearance, water blocking property, and workability during attachment of the terminal.

(5) Examples of the covered wire of the present disclosure include a mode in which the surface roughness Ra is 0.6 μm or more.

The above-described mode has excellent manufacturability because the above-described amount of moisture can be easily adjusted in the manufacturing process.

(6) Examples of the covered wire of the present disclosure include a mode in which the conductor includes a stranded wire, and each of a plurality of metal wires forming the stranded wire is an aluminum alloy wire.

The above-described mode is lighter in weight compared to the case where the above-described metal wire is a copper wire or a copper alloy wire. Also, in the above-described mode, bending is easier compared to the case where the conductor is a single aluminum alloy wire and has the same cross-sectional area. From this point of view, the above-described mode has excellent bendability.

(7) The wire harness according to one aspect of the present disclosure includes the covered wire according to any one of (1) to (6) above, a terminal, and a water blocking member, the terminal is attached to at least one of two end portions of the covered wire, and the water blocking member is attached to an outer periphery of the insulating covering.

The covered wire of the present disclosure provided in the wire harness of the present disclosure has excellent heat resistance and an excellent appearance. The wire harness of the present disclosure also has an excellent water blocking property and manufacturability for the above-described reasons.

Details of Embodiments of the Present Disclosure

Hereinafter, embodiments of the present disclosure will be described in detail with reference to the drawings as appropriate. Identical reference numerals in the figures indicate objects with identical names

Covered Wire

Hereinafter, a covered wire of an embodiment will be described with reference to FIG. 1.

The covered wire 1 of the embodiment includes a conductor 2 and an insulating covering 3. The conductor 2 includes a single metal wire 22 or a plurality of metal wires 22. FIG. 1 illustrates a case where the conductor 2 is a stranded wire 20 including a plurality of metal wires 22. The insulating covering 3 is a molded body made of a resin composition. The insulating covering 3 covers the outer periphery of the conductor 2. Typically, the insulating covering 3 is manufactured by extruding a resin mixture, which is the raw material of the insulating covering 3, onto the outer periphery of the conductor 2 to form a predetermined shape, and then cross-linking the resin mixture. The insulating covering 3 forms the outer surface of the covered wire 1. For this reason, the appearance of the insulating covering 3 is also the appearance of the covered wire 1.

In the covered wire 1 of the embodiment, the insulating covering 3 is made of a specific resin composition. Also, in the covered wire 1 of the embodiment, the surface roughness Ra of the insulating covering 3 is 4.0 μm or less. The surface of such an insulating covering 3 is smooth.

Hereinafter, the usage modes of the insulating covering 3, the conductor 2, and the covered wire 1 will be described in order.

Insulating Covering

Composition

The resin composition constituting the insulating covering 3 includes (A) a silane graft polyolefin, (B) an unmodified polyolefin, (C) a modified polyolefin, (D) a flame retardant, (E) a cross-linking catalyst, and (F) zinc oxide and an imidazole-based compound. The above-described resin composition may also further contain one or more additives selected from the group consisting of (G) an antioxidant, (H) a metal deactivator, and (I) a lubricant.

Hereinafter, each component of the above resin composition will be described. In the following description, regarding the content of each of the resin components (A), (B) and (C) in the above resin composition, the ratio by which each resin component is included in 125 parts by mass, which is obtained by adding up these three components, is indicated by the number of parts by mass. The content of each component other than the above three components in the above resin composition is indicated by the number of parts by mass with respect to 125 parts by mass, which is obtained by adding up the above-described three components. Note that the total parts by mass of the above-described overall resin composition containing the above-described resin components is, for example, at least 195 parts by mass and at most 250 parts by mass. Nuclear magnetic resonance spectroscopy (NMR) is typically used for the measurement of each component.

(A) Silane Graft Polyolefin

A silane graft polyolefin is obtained by graft-polymerizing a silane coupling agent to a polyolefin serving as a main chain, that is, by introducing a silane graft chain. The content of the silane graft polyolefin is, for example, at least 50 parts by mass and at most 80 parts by mass.

For example, the polyolefin in the silane graft polyolefin includes at least one type of polymer selected from a group consisting of polyethylene (PE), polypropylene (PP), and a copolymer of ethylene or propylene and α-olefin. PE is a homopolymer of ethylene. PP is a homopolymer of propylene. Examples of the above-described copolymer include an ethylene-butene copolymer and an ethylene-octene copolymer.

(B) Unmodified Polyolefin

The unmodified polyolefin is a polyolefin composed of hydrocarbons, and no modifying group has been introduced therein through graft polymerization, copolymerization, or the like. The content of the unmodified polyolefin is, for example, at least 30 parts by mass and at most 55 parts by mass.

Examples of the unmodified polyolefin include one or more polymers listed as polyolefins in (A) silane graft polyolefin. In particular, if the unmodified polyolefin and the polyolefin in (A) silane graft polyolefin contain the same type of polymer, they have excellent compatibility. For this reason, the resin mixture is easily kneaded uniformly in the manufacturing process. By using a uniformly-kneaded resin mixture, it is easy to manufacture a covered wire 1 having excellent heat resistance and an excellent appearance.

Alternatively, the unmodified polyolefin may include an olefin-based polyolefin elastomer. The polyolefin elastomer imparts flexibility to the insulating covering 3. Examples of the polyolefin elastomer include polyolefin-based thermoplastic elastomer (TPO), ethylene-propylene rubber (EPM, EPR), ethylene-propylene-diene copolymer (EPDM, EPT), and the like. Examples of TPO include polyethylene-based elastomers and polypropylene-based elastomers.

Alternatively, the unmodified polyolefin may include the above-described one or more types of polymers and a polyolefin elastomer. Specific examples may contain PE and PP elastomer. The polyolefin elastomer in this mode is thought to improve the fluidity of the resin mixture in the manufacturing process. In this mode, the total content of the above-described one or more types of polymers is, for example, at least 25 parts by mass and at most 45 parts by mass. The content of the polyolefin elastomer is, for example, at least 3 parts by mass and at most 10 parts by mass.

Alternatively, block polypropylene may be included as the unmodified polyolefin. Hereinafter, block polypropylene will be referred to as block PP. Block PP is thought to improve the fluidity of the resin mixture in the manufacturing process. The effect of improving the fluidity of the block PP is thought to be higher than the effect of improving the fluidity of the above-described polyolefin elastomer. Since the resin mixture containing the block PP has excellent fluidity, the insulating covering 3 having a smooth surface is easily manufactured. Also, as shown in a test example described later, when a resin mixture containing block PP is used, an insulating covering 3 having a smooth surface is easily manufactured even if the amount of moisture in the resin mixture is large to some extent, compared to the case where block PP is not included. From this point of view, it can be said that the resin mixture containing the block PP has a wide range of the above-described amount of moisture at which it is possible to manufacture the insulating covering 3 having a smooth surface. With such a resin mixture, the above-described amount of moisture is easy to adjust. For example, the drying time can be shortened. Alternatively, a drying task can be performed using, for example, simple equipment. Drying is preferably not required. Since an excessive degree of moisture adjustment is not necessary, the covered wire 1 including the insulating covering 3 containing the block PP has an excellent appearance as well as excellent manufacturability.

Alternatively, the unmodified polyolefin may contain the above-described one or more types of polymers and block PP. Specific examples may contain PE and block PP. Due to containing the block PP, the resin mixture has excellent fluidity in the manufacturing process as described above. In this mode, the total content of the above-described one or more types of polymers is, for example, at least 25 parts by mass and at most 45 parts by mass. The content of the block PP is, for example, at least 3 parts by mass and at most 10 parts by mass.

(C) Modified Polyolefin

The modified polyolefin herein has one or more functional groups selected from the group consisting of a carboxy group, an ester group, an acid anhydride group, an amino group, and an epoxy group. The content of the modified polyolefin is, for example, at least 3 parts by weight and at most 15 parts by weight. Since the modified polyolefin into which the silanol derivative is introduced is classified as (A) a silane graft polyolefin, it is not classified as (C) a modified polyolefin.

The modified polyolefin functions as a compatibilizer between (A) and (B), which are resin components, and zinc oxide, which is an inorganic component. Due to the dispersibility of the inorganic component being increased by this function, it is easy to manufacture the insulating covering 3 in which the inorganic component is uniformly dispersed. As a result, the covered wire 1 having excellent heat resistance is easily manufactured. Examples of the polyolefin in the modified polyolefin may contain one or more polymers listed as the polyolefins in (A) silane graft polyolefin.

Examples of the polymerizable compound having a carboxy group include acrylic acid, methacrylic acid, crotonic acid, α-chloroacrylic acid, itaconic acid, butene tricarboxylic acid, maleic acid, fumaric acid, and derivatives containing these as part of the molecular structure. If the acids listed above form an acid anhydride, the acid anhydride can be used to introduce an acid anhydride group.

Examples of the polymerizable compound having an ester group include vinyl acetate and vinyl propionate.

Examples of the polymerizable compound having an amino group include esters, vinylamines, allylamines, and derivatives containing these as part of their molecular structure.

Examples of the polymerizable compound having an epoxy group include glycidyl ethers, p-glycidyl styrene, and derivatives containing these as part of the molecular structure.

Examples of the polymerizable monomer that is copolymerizable with the above-mentioned polymerizable compound having a functional group include at least one of an olefin monomer having no functional group and a polymerizable monomer having a functional group other than the carboxy group and the epoxy group. Examples of the olefin monomer include PE and PP.

(D) Flame Retardant

The flame retardant may include, for example, at least one of a metal hydroxide and a bromine-based flame retardant.

With the metal hydroxide, it is possible to obtain effects such as being able to impart flame retardancy by itself, having excellent heat-resistant deformability, and being low in cost. Examples of the metal hydroxide include magnesium hydroxide, aluminum hydroxide, and zirconium hydride. If the metal hydroxide is contained alone as the flame retardant, the content of the metal hydroxide is, for example, at least 10 parts by weight and at most 100 parts by weight.

The bromine-based flame retardant may be included together with an inorganic flame retardant aid. Examples of the brominated flame retardant include one or more selected from the group consisting of phthalimide-based flame retardants, ethylene bispentabromophenyl, and derivatives of ethylene bispentabromophenyl. Since the brominated flame retardant listed above has a high melting point, the insulating covering 3 has excellent heat resistance. Examples of the inorganic flame retardant aid include antimony trioxide. The content of only the bromine-based flame retardant is, for example, at least 10 parts by mass and at most 40 parts by mass. The content of only the inorganic flame retardant aid is, for example, at least 5 parts by mass and at most 20 parts by mass.

If the flame retardant contains a metal hydroxide and a bromine-based flame retardant as the flame retardant, the content of the metal hydroxide and the content of the bromine-based flame retardant may be less than the above ranges. For example, the content of metal hydroxide is at least 10 parts by mass and at most 50 parts by mass, the content of bromine-based flame retardant is at least 5 parts by mass and at most 20 parts by mass, and the content of the inorganic flame retardant aid is at least 5 parts by mass and at most 20 parts by mass.

(E) Cross-Linking Catalyst

The cross-linking catalyst is a silanol condensation catalyst for silane cross-linking of (A) the silane graft polyolefin. The content of the cross-linking catalyst is, for example, at least 0.01 part by mass and at most 10 parts by mass.

Examples thereof include cross-linking catalysts such as metal carboxylic acid salts, titanic acid esters, organic bases, inorganic acids, and organic acids. More specifically, tin compounds such as dibutyltin dilaurate, dibutyltin dimaleate, dibutyltin bisisooctylthioglycol ester salt, and dibutyltin β-mercaptopropionate can be mentioned.

(F) Zinc Oxide and Imidazole-Based Compound

Zinc oxide and imidazole-based compounds contribute to the improvement of heat resistance and long-term heat resistance. The content of zinc oxide and the content of the imidazole-based compound are each, for example, at least 1 part by mass and at most 15 parts by mass. When the above-described content is within the above-described range, the insulating covering 3 has excellent heat resistance and long-term heating resistance, and zinc oxide and imidazole-based compounds are easily dispersed in the resin component in the manufacturing process. For this reason, it is easy to manufacture an insulating covering 3 in which zinc oxide and an imidazole-based compound are uniformly dispersed. As a result, the covered wire 1 having excellent heat resistance is easily manufactured.

Examples of the imidazole-based compound include mercaptobenzimidazole (MBI). In particular, if the imidazole-based compound is 2-mercaptobenzimidazole or a zinc salt thereof, the insulating covering 3 having excellent heat resistance can be obtained due to having excellent stability at high temperatures. Note that the imidazole-based compound is called an anti-aging agent because it prevents deterioration due to peroxide decomposition of rubber hydrocarbons instead of oxidative deterioration.

(G) Antioxidant

Examples of the antioxidant include a hindered phenol-based antioxidant. In particular, hindered phenol having a melting point of 200° C. or higher is preferable. The content of the antioxidant is, for example, at least 1 part by mass and at most 10 parts by mass. If the above-described content is in the above-described range, bloom caused by the antioxidant is suppressed. If the content is 2 parts by mass or more, an effect of improving heat resistance can also be expected.

(H) Metal Deactivator

Examples of the metal deactivator include metal deactivators having an operation of preventing oxidation of the conductor 2 due to contact between the metal constituting the conductor 2 and the insulating covering 3. For example, a copper deactivator, a chelating agent, or the like can be used. Specific examples include hydrazide derivatives and salicylic acid derivatives. The content of the metal deactivator is, for example, at least 0.5 parts by mass and at most 10 parts by mass. When the above-described content is within the above-described range, bloom and cross-linking inhibition caused by the metal deactivator are suppressed. Also, if the metal constituting the conductor 2 is copper or a copper alloy, the effect of preventing copper damage can be favorably obtained.

(I) Lubricant

The lubricant increases the lubricity of the insulating covering 3. From the viewpoint of compatibility with the above-described resin component, the lubricant is preferably a fatty acid derivative such as erucic acid, oleic acid, or stearic acid, or a polyethylene-based wax. The content of the lubricant is, for example, at least 0.1 parts by mass and at most 10 parts by mass.

Other Additives

In addition, the resin composition constituting the insulating covering 3 may contain additives other than the above-mentioned components as long as it has excellent heat resistance and does not impair the object of having a smooth surface. Examples of additives other than the above-described components include inorganic fillers, pigments, silicone oils and the like.

Examples of the inorganic filler include magnesium oxide and calcium carbonate. Inorganic fillers can be used to adjust the hardness of the resin. Due to the hardness of the resin being appropriately adjusted, the insulating covering 3 has excellent fusion resistance and heat deformation resistance. From the viewpoint of resin strength, the content of the inorganic filler is, for example, 30 parts by mass or less. The pigment can color the insulating covering 3.

Surface Roughness

Figure 2:
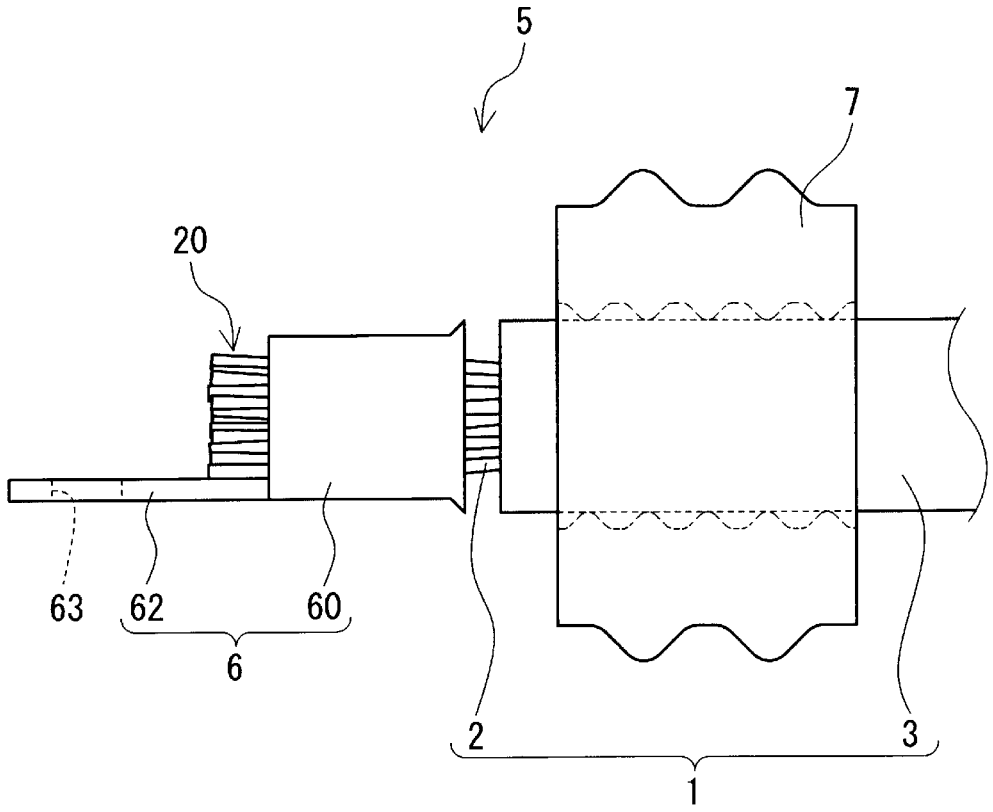
FIG. 2 is a side view showing an example of a wire harness of an embodiment.

The insulating covering 3 provided on the covered wire 1 of the embodiment has a smooth surface. Quantitatively, the surface roughness Ra of the insulating covering 3 is 4.0 μm or less. The covered wire 1 of such an embodiment has a smooth appearance. From this viewpoint, the covered wire 1 of the embodiment has an excellent appearance. Also, if the tubular water blocking member 7 (FIG. 2) is attached to the outer periphery of the insulating covering 3, the inner peripheral surface of the water blocking member 7 is in areal contact with the outer surface of the insulating covering 3. Due to this areal contact, no small gap appears between the outer surface of the insulating covering 3 and the inner peripheral surface of the water blocking member 7. For this reason, water does not enter a small gap due to the capillary phenomenon. The covered wire 1 of such an embodiment has an excellent water blocking property. Furthermore, due to the insulating covering 3 having a smooth surface, cutting debris from the insulating covering 3 is not likely to be generated when a worker or the like cuts the covered wire 1. For this reason, the cutting debris is not likely to accumulate in a processing machine such as a machine for cutting the covered wire 1 or a machine for attaching the terminal 6 (FIG. 2) to the end of the cut covered wire 1. As a result, the number of instances of performing maintenance such as removing the cutting debris from the processing machine is small. From this viewpoint, the covered wire 1 of the embodiment contributes also to improving of the manufacturability of the wire harness 5 (FIG. 2).

The smaller the surface roughness Ra is, the more excellent the appearance, water blocking property, and workability during attachment of the terminal 6 of the covered wire 1 are. From these effects, the surface roughness Ra is preferably 3.0 μm or less. The surface roughness Ra is more preferably 2.0 μm or less.

There is no limitation on the lower limit of the surface roughness Ra. However, in order to reduce the surface roughness Ra as much as possible, it is necessary to reduce the amount of moisture of the resin mixture as much as possible in the manufacturing process. Adjustment of excessive moisture, such as increasing the drying time, is required. From the viewpoint of manufacturability, the surface roughness Ra may also be 0.6 μm or more. When the surface roughness Ra is 0.8 μm or more, the drying time tends to be short.

When the surface roughness Ra is at least 0.6 μm and at most 4.0 μm, at least 0.8 μm and at most 3.0 μm, and at least 1.0 μm and at most 2.0 μm, the covered wire 1 having an excellent appearance can be manufactured with high productivity.

Thickness

The insulating covering 3 covers the outer periphery of the conductor 2. The insulating covering 3 is typically provided such that the outer diameter of the covered wire 1 is substantially the same at any position in the axial direction of the covered wire 1. The thickness of the insulating covering 3 corresponds to the distance between the outer peripheral surface of the conductor 2 and the outer peripheral surface of the covered wire 1. The thickness can be selected as appropriate within a range having a predetermined dielectric strength with respect to the working voltage. For example, in automobile applications, the thickness is at least 0.5 mm and at most 2.0 mm Note that among the working voltages used in automobiles, "high voltage" is specified in the 2015 version of JASO D624 (JP). "Low voltage" is specified in the 2014 version of JASO D611 (JP).

Outer Shape

In a cross section obtained when the covered wire 1 is cut with a plane orthogonal to the axial direction of the covered wire 1, the outer shape of the insulating covering 3 is typically circular. The outer surface of the insulating covering 3 is a cylindrical surface.

Conductor

Examples of the metal constituting the conductor 2 include pure aluminum, an aluminum alloy, pure copper, and a copper alloy. The conductor 2 made of pure aluminum or an aluminum alloy has the effects of being lighter than the conductor 2 made of pure copper or an aluminum alloy and not causing copper damage. In particular, the conductor 2 made of an aluminum alloy has more excellent mechanical properties such as strength and impact resistance than the conductor 2 made of pure aluminum. The conductor 2 made of pure copper or a copper alloy has more excellent conductivity than the conductor 2 made of pure aluminum or an aluminum alloy. Known compositions can be used as the composition of the aluminum alloy and the composition of the copper alloy.

Examples of the conductor 2 include the stranded wire 20 shown in FIG. 1, a single metal wire 22 (not shown), or an aggregate of stranded wires (not shown). The stranded wire 20 is formed by twisting a plurality of metal wires 22 together. The stranded wire aggregate is formed by twisting a plurality of stranded wires 20 together. The conductor 2 may be in either a form including one stranded wire 20 or a form including a plurality of stranded wires 20. The stranded wire 20 is easier to bend than a single metal wire having the same cross-sectional area, and thus has excellent bendability. The stranded wire aggregate has excellent flexibility and can ensure a large conductor cross-sectional area.

The conductor 2 in the present example is a stranded wire 20. Each of the plurality of metal wires 22 constituting the stranded wire 20 is an aluminum alloy wire. For this reason, the conductor 2 of the present example has effects such as being lightweight as described above, not causing copper damage, and having excellent bendability.

The outer diameter and cross-sectional area of the conductor 2 can be appropriately selected according to the application of the covered wire 1. For example, in automobile applications, the cross-sectional area is at least 3 $mm^2$ and at most 200 $mm^2$.

Application

Examples of applications of the covered wire 1 of the embodiment include a power supply line, an information communication line, and the like in a transport device such as an automobile, a ship, or an aircraft, and other devices including a robot. The power supply line is, for example, a wire for connecting a battery and a motor provided in a transport device such as the above-described automobile. The power supply line is generally a wire for high voltage applications. The information communication line is generally a wire for low voltage applications. With a wire for a high-voltage application, the conductor 2 generates heat due to Joule heat accompanying the application of current. If the current used is further increased, the heat generation amount of the conductor 2 is also increased. For that reason, high heat resistance is required for the insulating covering. Since the covered wire 1 of the embodiment includes the insulating covering 3 having excellent heat resistance as described above, it is suitable for a wire for high-voltage applications such as the above-described power supply line.

Automobile wires are classified into classes A to E according to the allowable heat resistant temperature according to ISO 6722, which is an international standard. Due to the covered wire 1 of the embodiment having excellent heat resistance as described above, for example, it may have a D-class characteristic, which is a heat resistant temperature of 150° C.

Wire Harness

The covered wire 1 of the embodiment is typically used in a state in which a terminal 6 (FIG. 2) is attached to at least one of the two end portions of the covered wire 1. Normally, a terminal 6 is attached to each of the two end portions of the covered wire 1. The covered wire 1 of the embodiment to which the terminal 6 is attached is used in a wire harness. Examples of the wire harness include a mode in which a single wire is provided and the wire is the covered wire 1 of the embodiment. Other examples of the wire harness include a mode in which a plurality of wires are provided and at least one of the plurality of wires is the covered wire 1 of the embodiment. The mode including a plurality of wires may also include a member for bundling the plurality of wires. Examples of the above-described bundling member include a tubular protective material such as a corrugated tube and a bundling material such as an adhesive tape.

Hereinafter, the wire harness of the embodiment will be described with reference to FIG. 2.

The wire harness 5 of the embodiment includes the covered wire 1 of the embodiment, the terminal 6, and the water blocking member 7. The terminal 6 is attached to at least one of the two end portions of the covered wire 1. The water blocking member 7 is attached to the outer periphery of the insulating covering 3. Known terminals and water blocking members can be used as the terminal 6 and the water blocking member 7. FIG. 2 illustrates a crimped terminal having a hole 63.

The terminal 6 is typically a metal fitting including a wire barrel portion 60 and a connection portion 62. The wire barrel portion 60 is a location of electrical connection with the conductor 2 provided in the covered wire 1. The wire barrel portion 60 of the present example is electrically and mechanically connected to the conductor 2 by being crimped to the conductor 2. The connection portion 62 is a location of electrical connection with the connection target of the covered wire 1. Illustration of the connection target of the covered wire 1 is omitted. The connection portion 62 of this example has a flat plate shape. Also, the connecting portion 62 includes a hole 63 penetrating through the front and underside of the connection portion 62. A bolt (not shown) is inserted into the hole 63. The connection portion 62 of the terminal 6 and the connection target are electrically and mechanically connected by the bolt.

The water blocking member 7 is typically a tubular rubber member, and has an inner diameter that is smaller than the outer diameter of the covered wire 1 and an outer diameter that is larger than the outer diameter of the covered wire 1. Since the inner diameter of the water blocking member 7 is wider than the outer diameter of the covered wire 1 due to the elastic deformation, the covered wire 1 can be inserted through the inner periphery of the water blocking member 7. Also, the inner diameter of the water blocking member 7 shrinks due to elastic contraction, whereby the inner peripheral surface of the water blocking member 7 comes into areal contact with the outer surface of the covered wire 1. Due to this areal contact, the state in which the water blocking member 7 is attached to the outer periphery of the covered wire 1 is maintained.

The wire harness 5 of the embodiment is typically used in a state in which the terminal 6 and its vicinity are arranged in a housing of a connector (not shown). The water blocking member 7 is arranged between the inner peripheral surface of the housing and the outer surface of the covered wire 1, and is compressed by both. The water blocking member 7 is elastically deformed by the above compression so as to be in areal contact with both surfaces. Due to this areal contact, the wire harness 5 of the embodiment can be suitably used in waterproofing applications due to having an excellent water blocking property.

Manufacturing Method for Covered Wire

The covered wire 1 of the embodiment is typically manufactured through the following covered wire manufacturing method. The method for manufacturing the covered wire includes a step of forming a covering layer by extruding a resin mixture containing the above-described components (A) to (F) onto the outer periphery of the conductor 2, and a step of cross-linking the covering layer. The resin mixture may also contain (G) to (I) and other additives as appropriate in addition to the above components. Commercially-available products can be used for each component constituting the resin mixture.

The above-described resin mixture is obtained by kneading the above-described components before extrusion. A known kneading machine can be used for kneading. As described above, if the components have excellent compatibility, a resin mixture having a uniform composition can be easily obtained.

In the manufacture of the above-described resin mixture, a batch containing at least one of the above-mentioned components and a binder resin can be used. Examples of the binder resin include one or more polymers listed as polyolefins in the above-mentioned (A) silane graft polyolefin. For example, if a batch containing a cross-linking catalyst is used, it is possible to expect an effect of preventing the silane cross-linking reaction in the silane graft polyolefin from progressing due to moisture in the atmosphere. When using a batch, the content of the binder resin may be adjusted such that the content of each component satisfies the above-described range.

Batches can also be manufactured over multiple stages. As a specific example, the method for manufacturing a covered wire includes a step of manufacturing a first batch, a step of manufacturing a second batch including the first batch, and a step of manufacturing a third batch including the second batch, and the third batch is extruded.

In the step of cross-linking the above-described covering layer, it is possible to adjust the cross-linking conditions such that the degree of cross-linking of the cross-linked insulating covering 3 has a gel fraction of 50% or more. The higher the gel fraction is, the more excellent the heat resistance of the insulating covering 3 is. From the viewpoint of heat resistance, the gel fraction may also be 60% or more. The gel fraction is generally used as an index of the cross-linking state of the cross-linked wire. The gel fraction can be measured according to, for example, the 2013 version of JASO D608.

In order to manufacture the covered wire 1 of the embodiment, the amount of moisture contained in the resin mixture before extrusion can be adjusted. In particular, by drying the resin mixture, the amount of moisture in the resin mixture can be reduced as compared with that before drying. Although it depends on the components of the resin mixture before extrusion, for example, the moisture content of the resin mixture can satisfy 700 mass ppm or less with the resin mixture set as 100 mass %. When the moisture content satisfies the above range, the insulating covering 3 having a smooth surface can be easily manufactured. The moisture content may also be 500 mass ppm or less and 300 mass ppm or less. The above-mentioned adjustment condition of the moisture amount may be set such that the moisture content (mass ppm) in the batch to be finally extruded becomes small. Also, for example, the surface roughness Ra of the insulating covering 3 can be set as an index for the adjustment conditions of the amount of moisture.

When batches are manufactured in multiple stages as described above, examples thereof include a mode in which each batch is dried, a mode in which only one random batch is dried, and a mode in which any plurality of batches are dried. The more steps of performing drying there are, and the longer the drying time is, the smaller the moisture content is likely to be. However, an increase in the number of steps and an increase in the drying time lead to a decrease in the manufacturability of the covered wire 1. From the viewpoint of manufacturability, for example, the amount of moisture can be adjusted such that the surface roughness Ra of the insulating covering 3 satisfies 0.6 μm or more.

In addition, known conditions can be referenced regarding the kneading conditions, extrusion conditions, cross-linking conditions, and the like.

Main Effects

The covered wire 1 of the embodiment has excellent heat resistance. Also, the covered wire 1 of the embodiment has a smooth surface due to the surface roughness Ra of the insulating covering 3 being small. The covered wire 1 of such an embodiment has an excellent appearance as well as an excellent water blocking property. The above effect will be specifically described using later-described test examples.

Test Example 1

A covered wire was manufactured using a plurality of resin mixtures having different compositions, and the appearance and water blocking property of each covered wire were examined.

In this test, a covering layer was formed by extruding a resin mixture onto the outer periphery of a conductor, and then an insulating covering was formed by cross-linking the covering layer. Accordingly, all of the covered wires manufactured in this test have a cross-linked insulating covering. The conductor here is an aggregate of stranded wires composed of a plurality of aluminum alloy wires.

Composition

Table 1 shows the composition of each resin mixture. In Table 1, the units of the content of each component constituting each resin mixture are parts by mass. Here, four types of resin mixtures, namely compositions No. 1 to No. 3, and No. 101, were prepared.

The resin mixtures of compositions No. 1 to No. 3 all include (A) a silane graft polyolefin, (B) an unmodified polyolefin, (C) a modified polyolefin, (D) a flame retardant, (E) a cross-linking catalyst, (F) zinc oxide and an imidazole-based compound, (G) an antioxidant, (H) a metal deactivator, (I) a lubricant, and (J) a pigment composition.

The resin mixtures of compositions No. 1 to No. 3 have different components of (B).

The resin mixtures of compositions No. 1 and No. 2 and composition No. 101, which will be described later, contain polyethylene (PE) and polypropylene elastomer (PP elastomer) as the component (B). The resin mixtures of compositions No. 1, No. 2 and No. 101 do not contain block polypropylene (block PP).

The resin mixture of composition No. 3 contains PE and block PP as the component (B). The resin mixture of composition No. 3 does not contain PP elastomer.

The resin mixture of composition No. 101 contains the component (A) to the component (E) and the component (G) to the component (J). The resin mixture of composition No. 101 does not contain the component (F).

The following commercially-available products were used as raw materials for each of the above-described components.

As the raw material of the (A) silane graft polyolefin, a batch containing silane graft polyethylene and polyethylene, which is a binder resin, was used. This batch is SH700N manufactured by Mitsubishi Chemical Corporation, and is shown as "Silane Graft Polyethylene Batch" in Table 1.

(B) PE is Engage ENR7256.02 manufactured by Dow Elastomer Corporation. The PE here is the base polymer and is shown as "base PE" in Table 1.

The PP elastomer used for composition No. 1 is Q200F manufactured by Sun Allomer Ltd.

The PP elastomer used in compositions No. 2 and No. 101 is NEWCON NAR6 manufactured by Japan Polypropylene Corporation.

The block PP used for composition No. 3 is EG7F manufactured by Japan Polypropylene Corporation.

The (C) modified polyolefin is Modic M512 manufactured by Mitsubishi Chemical Corporation, which is a maleic acid-modified polyethylene.

(D) The flame retardant is a metal hydroxide. The specific flame retardant is KISUMA 5, manufactured by Kyowa Chemical Industry Co., Ltd., which is magnesium hydroxide.

As the raw material of the (E) cross-linking catalyst, a batch was used which contained less than 1 part by mass of a tin compound, the remaining portion being the binder resin. The binder resin is polyethylene. This batch is LZ015H manufactured by Mitsubishi Chemical Corporation.

(F) Zinc oxide is a type of zinc oxide manufactured by Hakusui Tech Co., Ltd. The imidazole-based compound is ANTAGE MB manufactured by Kawaguchi Chemical Industry Co., Ltd., which is 2-mercaptobenzimidazole.

(G) The antioxidant is Irganox 1010 manufactured by BASF Japan Ltd., which is a hindered phenol-based antioxidant.

The (H) metal deactivator is CDA-1 manufactured by ADEKA Corporation, which is a hydrazide derivative.

The lubricant is ALFLOW P10 manufactured by NOF CORPORATION, which is an erucic acid amide.

As the (J) pigment composition, a batch was used which contained 1 part by mass of the pigment, the remaining portion being a binder resin. The binder resin is polyethylene. This batch is a commercially-available color batch.

In this test, batches were manufactured over multiple stages. For the resin mixtures of compositions No. 1 to No. 3, the first batch, the second batch, and the third batch were manufactured in order. The first batch contains component (B), component (C) and component (F) and does not include the remaining components listed in Table 1. The second batch contains the first batch, the component (D), the component (G), the component (H), and the component (I), and does not contain the remaining components listed in Table 1. The third batch includes the second batch, the component (A), the component (E), and the component (J). That is, the third batch contains all of the ingredients listed in Table 1.

For the resin mixtures of compositions No. 1 to No. 3, the amount of moisture contained in the second batch described above was adjusted. Here, the moisture content was changed by changing the amount of time for drying the second batch after measuring the moisture content (mass ppm) of the second batch. The longer the drying time is, the smaller the moisture content is, compared to the state before the drying task. For the measurement of the moisture content, for example, the Karl Fischer method may be used. Also, a commercially-available moisture content measuring device can be used for measuring the moisture content. Note that the moisture contained in the second batch is caused by the absorption of moisture in the second batch. For this reason, depending on the surrounding environment and the like, the above-mentioned amount of moisture may be small in the state before the drying task. In this case, the drying time may be short. Alternatively, the drying task is not needed in some cases.

In the resin mixture of composition No. 101, the following fourth batch and fifth batch were manufactured in order. The fourth batch contains component (B), component (C), component (D), component (G), component (H), component (I) and does not contain the remaining components listed in Table 1. That is, the components of the fourth batch are the components obtained by removing the component (F) from the above-mentioned second batch. The fifth batch contains the fourth batch, the component (A), the component (E), and the component (J). That is, the fifth batch contains all of the components listed in Table 1 except component (F).

TABLE 1

| | Components | Composition No. 101 | 1 | 2 | 3 |
|---|---|---|---|---|---|
| B | Base PE | 40 | 40 | 40 | 40 |
| | PP Elastomer (NAR6) | 8 | — | 8 | — |
| | PP Elastomer (Q200F) | — | 8 | — | — |
| | Block PP | — | — | — | 8 |
| C | Maleic acid-modified polyethylene | 7 | 7 | 7 | 7 |
| F | Imidazole-based compound | — | 12 | 12 | 12 |
| | Zinc oxide | — | 8 | 8 | 8 |
| D | Metal hydroxide | 80 | 80 | 80 | 80 |
| G | Antioxidant | 1 | 5 | 5 | 5 |
| H | Metal deactivator | 2 | 2 | 2 | 2 |
| I | Lubricant | 0.5 | 0.5 | 0.5 | 0.5 |
| A | Silane graft polyethylene batch | 70 | 70 | 70 | 70 |
| E | Cross-linking catalyst batch | 1 | 1 | 1 | 1 |
| J | Color batch | 3 | 3 | 3 | 3 |
| Total, parts by mass | | 212.5 | 236.5 | 236.5 | 236.5 |

Appearance

Surface Roughness

The surface roughness Ra (μm) of the insulating covering was measured for the covered wire of each sample manufactured using each of the above-described resin mixtures. The measurement results are shown in Tables 2 to 4. The surface roughness Ra is the arithmetic mean roughness. The surface roughness Ra was measured using a commercially-available surface roughness measurement machine in accordance with JIS B 0601:2013.

Gloss and Roughness

The acceptability of the appearance of the covered wire of each sample was evaluated based on the presence or absence of gloss and unevenness of the insulating covering and the presence or absence of roughness of the insulating covering. The presence or absence of the gloss and unevenness was confirmed by visually checking the insulating covering. The presence or absence of the above-mentioned roughness was confirmed by the operator touching the insulating covering with an index finger of a bare hand. The evaluation was performed as follows by comparing a predetermined reference product with the insulating covering in each sample. The evaluation results are shown in Tables 2 to 4.

The above-described reference product is one covered wire selected as appropriate from a plurality of covered wires manufactured by using the resin mixture of composition No. 3. The surface roughness Ra of the insulating covering provided in the above-described reference product was 3.5 μm.

Evaluation of Gloss and Unevenness

An evaluation of Very Good means that the gloss of the insulating covering in each sample is superior to that of the reference product, and it is difficult to visually confirm the unevenness.

An evaluation of Good means that the gloss of the insulating covering in each sample is equivalent to that of the reference product, and it is difficult to visually confirm the unevenness.

An evaluation of Bad means that the gloss of the insulating covering in each sample is inferior to that of the reference product and it is difficult to visually confirm the unevenness.

An evaluation of Very Bad means that the gloss of the insulating covering in each sample is inferior to that of the reference product and that unevenness can be visually confirmed.

Evaluation of Roughness

An evaluation of Very Good means that the roughness of the insulating covering in each sample is less than that of the reference product and is superior to that of the reference product.

An evaluation of Good means that the roughness of the insulating covering in each sample is equivalent to that of the reference product.

An evaluation of Bad means that the roughness of the insulating covering in each sample is greater than that of the reference product and is inferior to that of the reference product.

An evaluation of Very Bad means that the roughness of the insulating covering in each sample is clearly inferior to that of the reference product. This roughness is a roughness that is so large that the tester may feel pain when the tester touches the insulating covering.

Water Blocking Property

The quality of the water blocking property was evaluated for the covered wire of each sample based on whether or not water entered from the boundary between the insulating covering and a rubber stopper, which is a water blocking member. Here, a test was conducted based on IEC 60529: 2001 to evaluate whether or not a waterproof performance of IP grade 3 was satisfied. The evaluation results are shown in Tables 2 to 4.

An evaluation of Good means that there is no intrusion from the above-described boundary, that is, a waterproof performance of IP grade 3 is satisfied.

An evaluation of Bad means that there is intrusion from the above boundary, that is, a waterproof performance of IP grade 3 is not satisfied.

TABLE 2

| Sample No. | 1 | 2 | 51 | 52 | 111 |
|---|---|---|---|---|---|
| Composition No. | 1 | | | | 101 |
| Amount of moisture (mass ppm) | 150 | 300 | 500 | 1000 | — |

TABLE 2-continued

| Sample No. | 1 | 2 | 51 | 52 | 111 |
|---|---|---|---|---|---|
| Surface roughness (μm) | 3.0 | 3.8 | 4.8 | 9.5 | 1.0 |
| Gloss | Very Good | Good | bad | Very bad | Very Good |
| Roughness | Good | Good | Very bad | Very bad | Very Good |
| Water blocking property | Good | Good | bad | bad | Good |

TABLE 3

| Sample No. | 3 | 4 | 53 | 54 |
|---|---|---|---|---|
| Composition No. | 2 | | | |
| Amount of moisture (mass ppm) | 150 | 290 | 450 | 1000 |
| Surface roughness (μm) | 2.8 | 3.4 | 4.5 | 9.0 |
| Gloss | Very Good | Good | bad | Very bad |
| Roughness | Good | Good | Very bad | Very bad |
| Water blocking property | Good | Good | bad | bad |

TABLE 4

| | Sample No. | | | | | |
|---|---|---|---|---|---|---|
| | 5 | 6 | 7 | 8 | 55 | 56 |
| Composition No. | 3 | | | | | |
| Amount of moisture (mass ppm) | 150 | 300 | 500 | 700 | 750 | 990 |
| Surface roughness (μm) | 1.0 | 1.8 | 3.0 | 3.8 | 4.3 | 8.0 |
| Gloss | Very Good | Very Good | Very Good | Good | Good | bad |
| Roughness | Very Good | Very Good | Good | Good | bad | Very bad |
| Water blocking property | Good | Good | Good | Good | bad | bad |

Hereinafter, the covered wires of Samples No. 1 to No. 8 are referred to as a specific wire group. The covered wires of Samples No. 51 to No. 56 are called a comparative wire group.

As shown in Tables 2 to 4, the specific wire group has gloss and therefore has an excellent appearance. Also, the specific wire group has an excellent water blocking property. Furthermore, the specific wire group has no unevenness that causes roughness. From this viewpoint, the operator can easily handle the specific wire group.

The comparative wire group does not have gloss and is inferior in appearance. Also, the comparative wire group also has an inferior water blocking property. Furthermore, the comparative wire group includes a covered wire having unevenness that causes roughness. From this viewpoint, the operator needs to be careful in handling the comparative wire group.

One of the reasons for obtaining the above results is considered to be the difference in the surface roughness Ra of the insulating covering. The surface roughness Ra of the insulating covering in the specific wire group is 4.0 μm or less. The smaller the surface roughness Ra is, the more gloss there is and the less roughness there is. From the viewpoint of the appearance and the water blocking property, the surface roughness Ra is preferably 3.5 μm or less, more preferably 3.0 μm or less, and more preferably 2.5 μm or less. Also, when the (B) unmodified polyolefin contains the block PP, the above-described surface roughness Ra tends to be smaller than that in the case of containing the PP elastomer. From this viewpoint, it is thought that the block PP has a greater effect of improving the fluidity of the resin mixture in the manufacturing process than the PP elastomer. Also, it is thought that an insulating covering having a smooth surface is easily formed by using a resin mixture containing block PP.

The covered wire of Sample No. 111 has an excellent appearance and water blocking property due to the surface roughness Ra of the insulating covering being small. However, the covered wire of sample No. 111 has inferior heat resistance compared to the specific wire group. The heat resistance of the covered wire of sample No. 111 is C class, which is a heat resistance temperature of 120° C., specified in ISO 6722. By contrast, the heat resistance of the specific wire group is D class, which is a heat resistance temperature of 150° C., specified in ISO 6722. One of the reasons why the specific wire group has excellent heat resistance is that the resin composition constituting the insulating covering contains the component (F). One of the other reasons is that the resin composition contains a greater amount of component (G) than sample No. 111.

Next, the results of studying the cause of the difference in the surface roughness Ra of the insulating covering will be described.

First, based on a comparison between the specific wire group and the covered wire of Sample No. 111, it is thought that the presence or absence of the component (F) influences the surface roughness Ra. Since the imidazole-based compound and zinc oxide contained in the resin mixture are powders, the fluidity of the resin mixture tends to be lowered. It is thought that the decrease in fluidity of the resin mixture was a factor causing melt fracture and the like.

Next, the specific wire group and the comparative wire group will be compared. Both have in common that they contain the component (F). However, the surface roughnesses Ra of the two insulating coverings are different. One of the reasons for this difference is thought to be the difference in the moisture content (mass ppm) contained in the resin mixture in the manufacturing process. The moisture content (mass ppm) shown in Tables 2 to 4 is the mass ratio of moisture contained in the second batch with respect to the second batch described above. Here, the smaller the moisture content (mass ppm) of the second batch is, the smaller the surface roughness Ra is. Note that immediately before extruding the above-mentioned third batch, the absolute value (grams) of the moisture content in the above-described second batch may not change substantially. Alternatively, the increase in the absolute value (grams) of the above-described water content may be small. In the above case, the moisture content (mass ppm) of the third batch is smaller than the moisture content (mass ppm) of the second batch. It is expected that the influence of moisture on the surface roughness tends to be smaller due to the moisture content (mass ppm) of the third batch, which is the resin mixture immediately before extrusion, being smaller. Consequently, a covered wire having a smaller surface roughness Ra is likely to be manufactured.

As shown in Tables 2 and 3, in the resin mixtures of compositions No. 1 to No. 4, if the moisture content of the second batch is 400 mass ppm or less, the surface roughness Ra is 4.0 μm or less.

As shown in Table 4, in the resin mixture of composition No. 3, if the moisture content of the second batch is less than 750 mass ppm, the surface roughness Ra is 4.0 μm or less. When the moisture content is 700 mass ppm or less, the surface roughness Ra more reliably satisfies 4.0 μm or less. With the resin mixture of composition No. 3, it is possible to manufacture an insulating covering having a smaller surface roughness Ra even if the moisture content of the second batch is higher than that of the resin mixtures of compositions No. 1 to No. 4. From this viewpoint, the drying time of the second batch in composition No. 3 may be shorter than the drying time in compositions No. 1 to No. 4. Alternatively, in composition No. 3, drying can be omitted in some cases. From this result, it can be said that the drying time in the case where the resin mixture contains block polyolefin tends to be shorter than the drying time in the case where the resin mixture contains polyolefin elastomer.

Note that based on Table 4, it is estimated that the moisture content of the second batch used in the manufacture of the above-mentioned reference product was about 600 mass ppm.

For the covered wire of each sample, a cross section cut by a plane orthogonal to the axial direction of the covered wire was taken, and the above-described cross section was observed. In the comparative wire group, air bubbles were observed in the insulating covering. Also, in the region near the outer surface of the insulating covering, there were more bubbles in the insulating covering than in the interior near the conductor. Thus, in the comparative wire group, there was a clear difference in the distribution state of air bubbles between the interior and the region on the outer surface side of the insulating covering. On the other hand, in the specific wire group, air bubbles were substantially not observed, or a difference in the distribution state of air bubbles was substantially not observed. In the specific wire group, it is thought that the insulating covering tends to have a smooth surface because the moisture content is small as described above and thereby there are few or substantially no air bubbles on the outer surface side of the insulating covering.

From the above, it was shown that the covered wire in which the insulating covering is composed of a specific resin composition and the surface roughness Ra of the insulating covering is 4.0 μm or less has excellent heat resistance and an excellent appearance. It was also shown that the above-described covered wire has an excellent water blocking property. Furthermore, it has been shown that such a covered wire can be manufactured by using a resin mixture having a specific composition as a raw material and reducing the moisture content of the resin mixture.

The present invention is not limited to these illustrative examples, but is indicated by the scope of claims, and all modifications within the meaning and scope equivalent to the scope of claims are intended to be encompassed therein.

For example, in test example 1, the type and content of the components of the resin mixture used as the raw material for the insulating covering can be changed as appropriate. For example, the resin mixture of test example 1 need not contain a pigment.

From the foregoing, it will be appreciated that various exemplary embodiments of the present disclosure have been described herein for purposes of illustration, and that various modifications may be made without departing from the scope and spirit of the present disclosure. Accordingly, the various exemplary embodiments disclosed herein are not intended to be limiting, with the true scope and spirit being indicated by the following claims.

What is claimed is:

1. A covered wire including a conductor and an insulating covering, wherein the insulating covering is made of a resin composition and configured to form an outermost surface of the covered wire, the resin composition includes:

a silane graft polyolefin, an unmodified polyolefin, a modified polyolefin having one or more functional groups selected from a group consisting of a carboxy group, an ester group, an acid anhydride group, an amino group, and an epoxy group, a flame retardant, a cross-linking catalyst, and a zinc oxide and an imidazole-based compound, and wherein a surface roughness Ra of the insulating covering is 4.0 μm or less.

2. The covered wire according to claim 1, wherein the unmodified polyolefin includes block polypropylene.

3. The covered wire according to claim 1, wherein the surface roughness Ra of the insulating covering is 3.0 μm or less.

4. The covered wire according to claim 1, wherein the surface roughness Ra of the insulating covering is 2.0 μm or less.

5. The covered wire according to claim 1, wherein the surface roughness Ra of the insulating covering is 0.6 μm or more.

6. The covered wire according to claim 1, wherein the conductor includes a stranded wire, and each of a plurality of metal wires forming the stranded wire is an aluminum alloy wire.

7. The covered wire according to claim 1, wherein a content of each of the zinc oxide and the imidazole-based compound ranges from 1 part by mass to 15 parts by mass.

8. A wire harness comprising:

a covered wire including a conductor and an insulating covering, wherein the insulating covering is made of a resin composition and configured to form an outermost surface of the covered wire, the resin composition includes:

a silane graft polyolefin;

an unmodified polyolefin;

a modified polyolefin having one or m ore functional groups selected from a group consisting of a carboxy group, an ester group, an acid anhydride group, an amino group, and an epoxy group;

a flame retardant, a cross-linking catalyst, and a zinc oxide and an imidazole-based compound, a terminal; and a water blocking member, wherein a surface roughness Ra of the insulating covering is 4.0 μm or less, the terminal is attached to at least one of two end portions of the covered wire, and the water blocking member is attached to an outer peripheral surface of the insulating covering that serves as the outermost surface of the covered wire.

9. The wire harness according to claim 8, wherein a content of each of the zinc oxide and the imidazole-based compound ranges from 1 part by mass to 15 parts by mass.

* * * * *